US012808380B2

(12) United States Patent
Brooks et al.

(10) Patent No.: US 12,808,380 B2
(45) Date of Patent: Nov. 24, 2026

(54) FLUID TRANSPORTATION NETWORK AND METHOD

(71) Applicant: BELIMO HOLDING AG, Hinwil (CH)

(72) Inventors: Andy Brooks, Rapperswil (CH); Urs Keller, Hinwil (CH); Andreas Allenspach, Winterhur (CH)

(73) Assignee: BELIMO HOLDING AG, Hinwil (CH)

( * ) Notice: Subject to any disclaimer, the term of this patent is extended or adjusted under 35 U.S.C. 154(b) by 167 days.

(21) Appl. No.: 18/697,756

(22) PCT Filed: Oct. 4, 2022

(86) PCT No.: PCT/EP2022/077501
§ 371 (c)(1),
(2) Date: Apr. 2, 2024

(87) PCT Pub. No.: WO2023/057409
PCT Pub. Date: Apr. 13, 2023

(65) Prior Publication Data

US 2024/0410374 A1 Dec. 12, 2024

(30) Foreign Application Priority Data

Oct. 7, 2021 (CH) ..... 70361/2021

(51) Int. Cl.
*F04D 15/02* (2006.01)
*F04D 15/00* (2006.01)

(52) U.S. Cl.
CPC ..... *F04D 15/029* (2013.01); *F04D 15/0005* (2013.01); *F04D 15/0281* (2013.01); *F04D 15/0066* (2013.01)

(58) Field of Classification Search
CPC ..... F04D 15/029; F04D 15/0005; F04D 15/0281; F04D 15/0066; F24D 19/1012;
(Continued)

(56) References Cited

U.S. PATENT DOCUMENTS

2003/0235492 A1* 12/2003 Mirsky ..... F04D 15/0022 415/1
2019/0107292 A1 4/2019 Mischler et al.
2024/0053060 A1* 2/2024 Sheppard ..... F24D 3/08

FOREIGN PATENT DOCUMENTS

CN 101787969 A 7/2010
CN 106338060 A 1/2017
(Continued)

OTHER PUBLICATIONS

English translation of JP2018136109(A) generated from Espacenet website Mar. 2026. (Year: 2026).*
(Continued)

*Primary Examiner* — Bryan M Lettman
(74) *Attorney, Agent, or Firm* — Sughrue Mion, PLLC

(57) ABSTRACT

A fluid transportation network includes plural parallel zones, a common supply line for feeding a total flow of fluid to the parallel zones, each parallel zone being connected to the common supply line and associated with a pump that controls a flow of fluid through the respective parallel zone, one or more zone valves arranged in one of the parallel zones and controlling the flow of fluid through the parallel zone, and a processor that controls one or more of the pumps, and/or the at least one zone valve, to control the flow of fluid through the parallel zones. The pumps control the flow of fluid through one or more of the plural parallel zones only when a respective pump is operating within a specified efficient operating range of the respective pump, and the
(Continued)

respective pump regulates flow of fluid above a respective flow threshold value of the respective pump.

18 Claims, 4 Drawing Sheets

(58) Field of Classification Search
CPC ..... F24D 19/1015; F24F 3/06; F24F 11/84; F24F 11/85; F24F 11/46
See application file for complete search history.

(56) References Cited

FOREIGN PATENT DOCUMENTS

| | | | | |
|---|---|---|---|---|
| CN | 106594841 | A | | 4/2017 |
| CN | 112031080 | A | | 12/2020 |
| CN | 112127424 | A | | 12/2020 |
| CN | 112556098 | A | | 3/2021 |
| DE | 1001 4045 | A1 | | 10/2001 |
| EP | 1 163 478 | A1 | | 12/2001 |
| EP | 1209364 | A2 | | 5/2002 |
| EP | 2 434 226 | A2 | | 3/2012 |
| GB | 2617755 | B | | 10/2023 |
| JP | 57-136010 | A | | 8/1982 |
| JP | 2013-204833 | A | | 10/2013 |
| JP | 2018136109 | A | * | 8/2018 |
| WO | 00/57111 | A1 | | 9/2000 |
| WO | 2021/013355 | A1 | | 1/2021 |

OTHER PUBLICATIONS

Communication dated Jun. 5, 2026, issued in European Application No. 22797383.1.
International Search Report issued Jan. 23, 2023 in International Application No. PCT/EP2022/077501.
Search Report issued Jan. 19, 2022 in Swiss Application No. 703612021.
Communication dated Sep. 16, 2026 in Chinese Application No. 202280066299.3.

* cited by examiner

FLUID TRANSPORTATION NETWORK AND METHOD

CROSS-REFERENCE TO RELATED APPLICATIONS

This is a National Stage of International Application No. PCT/EP2022/077501 filed Oct. 4, 2022, claiming priority based on Swiss Patent Application No. 070361/2021 filed Oct. 7, 2021, the contents of each of which being herein incorporated by reference in their entireties.

FIELD OF THE DISCLOSURE

The present disclosure relates to a fluid transportation network and a method for controlling the fluid transportation network. In particular, the present disclosure relates to a fluid transportation network and a method for controlling the fluid transportation network which comprises one or more parallel zones, whereby each zone is connected to a common supply line.

BACKGROUND

Fluid transportation systems and networks typically comprise a plurality of consumers in different zones, with parallel branches or lines, through which a liquid or gaseous fluid is transported, for example in Heating, Ventilating, and Air Conditioning (HVAC) system for distributing thermal energy. The consumers and zones typically have different designs, with different diameters and/or lengths of fluid transport lines, for example, pipes, ducts and other and conduits, and have different and/or varying flow rates and/or throughput. In order to achieve a balanced and/or controlled distribution of the fluid to the consumers in such fluid transport systems, the zones and/or consumers are provided with flow control valves, for example actuated valves with electric motors, configured to adjust the flow through the respective consumer at different degrees of opening and/or valve positions.

In fluid transportation systems, centrifugal pumps provide the main force to drive and move fluid through fluid transportation lines, e.g. pipes, cooling and heating equipment, such as chillers, boilers, and consumers, such as thermal energy exchangers, e.g. heat exchanger or radiators. Traditionally, the centrifugal pumps are located in a central location with the cooling or heating equipment. Different types of valves such as control valves and balancing valves are installed in the fluid transportation systems in order to set and control the flow of fluid, thereby creating pressure drops and power losses across the valves. The central distribution pumps are usually chosen between constant speed pumps or variable speed pumps. However, the described systems suffer from excessive energy consumption and lack of efficiency.

As an alternative to systems using central pumps, systems using distributed pumping schemes using variable speed pumps have been proposed. Decentralized pumping systems may require less pumping power and, thus, have a lower energy consumption than central pumping systems. Known as variable speed pumping systems, they can be arranged in variable-primary pumping arrangement, primary-secondary pumping arrangement, or primary-secondary-tertiary pumping arrangement. For example, in the variable-primary pumping arrangement, the primary pumps have variable speed.

GB2245967A discloses an air conditioning system which includes a plurality of independently controlled air-to-water heat exchangers or groups of heat exchangers for heating or cooling air before circulation. Means are provided for supplying hot or cold water to the heat exchangers together with a plurality of variable speed pumps. Each variable speed pump has the function of varying the flow rate of the water supply through one independently controlled heat exchanger or group of heat exchangers according to the required temperature of the air.

U.S. Pat. No. 6,607,141B2 discloses decentralized centrifugal pumps with variable speed drives located at cooling or heating coils which are utilized to circulate and control the flow of liquid through the coils, main supply line, and main return line. The pump speed is controlled to satisfy temperature or pressure settings of a control agent served by the coil. Central distribution pumps, modulating control valves, and balancing valves are no longer required to circulate and control the flow.

SUMMARY OF THE DISCLOSURE

It is an object of this invention to provide a fluid transportation network and a method for controlling the fluid transportation network, which fluid transportation network and method do not have at least some of the disadvantages of the prior art.

According to the present disclosure, these objects are achieved through the features of the independent claims. In addition, further advantageous embodiments follow from the dependent claims and the description.

According to the present disclosure, a fluid transportation network is proposed. The fluid transportation network comprises a plurality of parallel zones; a common supply line for feeding a total flow of fluid to the plurality of parallel zones, whereby each parallel zone is connected to the supply line and associated with a pump, the pump being configured to control a flow of fluid through the respective zone; at least one zone valve arranged in one of the zones and configured to control the flow of fluid through the zone; and a processing unit configured to control at least one of the pumps, associated with the zones, and/or the at least one zone valve, to control the flow of fluid through the zones, whereby the pumps are used to control the flow of fluid through a particular zone or plurality of zones only when a respective pump is operating within a specified efficient operating range of the respective pump, where the respective pump is regulating a flow of fluid above a respective flow threshold value of the respective pump.

It is pointed out here that while the term "pump" is used in connection with controlling the flow of fluid in the fluid transportation network, in case of a gaseous fluid, e.g. air, the pumps are implemented as motorized fans or ventilators. Likewise, while the term "valve" is used in connection with controlling the flow of fluid in the fluid transportation network, in case of a gaseous fluid, e.g. air, the valves are implemented as dampers.

In an embodiment, the processing unit is configured to control the respective pump to control the flow of fluid through a particular zone only when the flow setpoint for the particular zone is above the respective flow threshold value of the respective pump.

In an embodiment, the flow of a particular zone is controlled by the one pump associated with that particular zone, particularly by the pump arranged in that particular zone.

In an embodiment, at least one pump is configured to deliver flow in more than one zone, and the flow of these zones is controlled by an individual valve for each of these zones.

In an embodiment, only the zone valve of a particular zone is used to control the flow in the particular zone when the flow setpoint for the particular zone is below the respective flow threshold value.

In an embodiment, at least one of the zones comprises a flow sensor.

In an embodiment, the flow threshold value of at least one pump is in a range from 15% to 50% of a maximum flow of the respective pump. In an embodiment, the flow threshold value of each pump is in the range from 15% to 50% of the maximum flow of the respective pump.

In an embodiment, at least two parallel zones are connected through a connecting pipe, located between the pump and a thermal exchange unit of the respective zones, and the connecting pipe comprises a connecting valve.

In an embodiment, the connecting valve is associated with one of the zones and configured to control the flow in that one of the zones.

In an embodiment, the respective flow threshold value of the pump is a function of a threshold rotational speed of the pump or of a threshold rotational speed of the pump in relation to a pump pressure ratio.

In an embodiment, the fluid transportation network further comprises a main pump configured to provide the total flow of fluid.

In an embodiment, the processing unit comprises a plurality of separate processing units.

In an embodiment, each of the zones comprises a zone processing unit. The zone processing units may be connected to a main processing unit.

Depending on the embodiment, the fluid is a liquid or gaseous fluid.

In an embodiment, each zone comprises one or more thermal exchange units.

A further aspect of the disclosure is related to a method of controlling a fluid transportation network. The proposed method comprises the steps of:

- supplying a total flow of fluid to a supply line;
- dividing the total flow of fluid into flow of fluids for each parallel zone;
- regulating the flow of fluids in each zone using a respective pump and/or a zone valve such that:
  - a) the respective pump, alone or in combination with the zone valve, is used to control the flow in a particular zone only when the respective pump is operating within a specified efficient operating range of the respective pump, where the respective pump is regulating a flow of fluid above a respective flow threshold value of the respective pump; and
  - b) only the zone valve is used to control the flow in the particular zone when the respective pump is operating outside the specified efficient operating range of the respective pump.

In an embodiment, the respective pump is used to control the flow of fluid through the particular zone only when the flow setpoint for the particular zone is above the respective flow threshold value of the respective pump.

In an embodiment of the method, in the case when only the zone valves are used to control the flow of fluid in the fluid transportation network, at least one of the zone valves is set to a completely open position by adjusting the speed of a main pump, arranged in the supply line, or the speed of one of the pumps associated with the zones.

BRIEF DESCRIPTION OF THE DRAWINGS

The present disclosure will be explained in more detail, by way of example, with reference to the drawings in which.

DETAILED DESCRIPTION OF EMBODIMENTS

Figure 1:
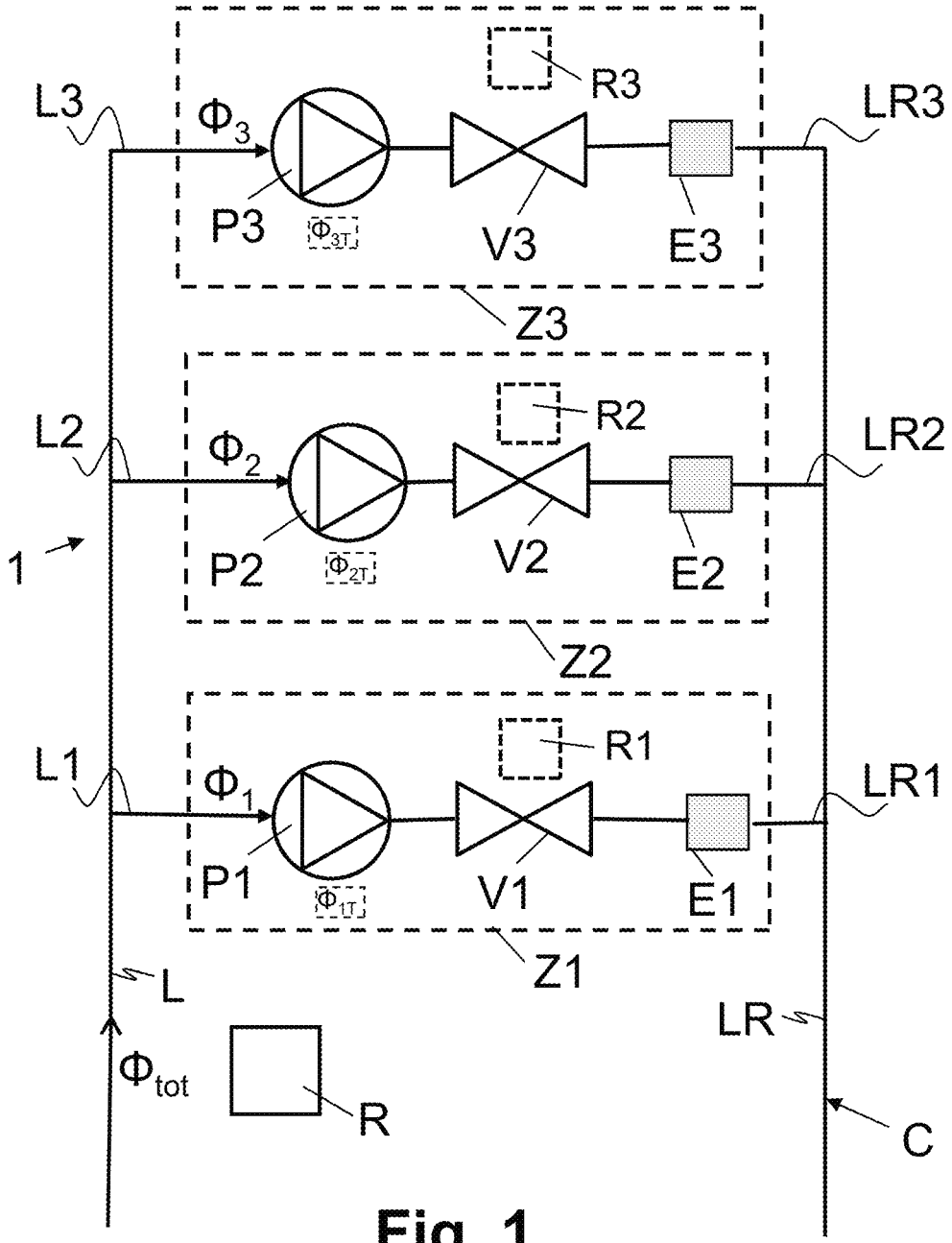
FIG. 1: shows a block diagram illustrating schematically an example of a fluid transportation network, comprising a fluid transportation circuit and three parallel zones in accordance with the disclosure.

In FIGS. 1 to 4, reference numeral 1 refers to a fluid transportation network, e.g. a hydraulic or hydronic network, which comprises a plurality of parallel zones Z1, Z2 and Z3. For example, the fluid transportation network 1 is part of an HVAC system. The fluid transportation network 1 includes at least one fluid transportation circuit C, with fluid transportation lines L, L1, L2, L3, e.g. pipes, for transporting a liquid heat transportation medium, e.g. water or a water/glycol mixture. As illustrated schematically in FIGS. 1 to 4, each of the zones Z1, Z2, Z3 comprises thermal energy exchangers E1, E2, and E3, e.g. a heat exchanger for heating the zone Z1, Z2, Z3 or a cooling device for cooling the zones Z1, Z2, and Z3 or rooms associated with the zones Z1, Z2, Z3, respectively. It should be noted that the fluid transportation network 1 shown in FIGS. 1 to 4 is highly simplified and in actual configurations comprises more than three zones Z1, Z2 and Z3, and possibly more fluid transportation circuits C.

Each of the parallel zones Z1, Z2 and Z3 is connected to the supply line L, which is provided for feeding a total flow of fluid $\phi_{tot}$ to the plurality of parallel zones Z1, Z2, and Z3. Each of the parallel zones is connected to the supply line L trough a respective zone supply line L1, L2, L3 and a respective zone return line LR1, LR2 and LR3 (connected to the main return line LR).

Figure 2:
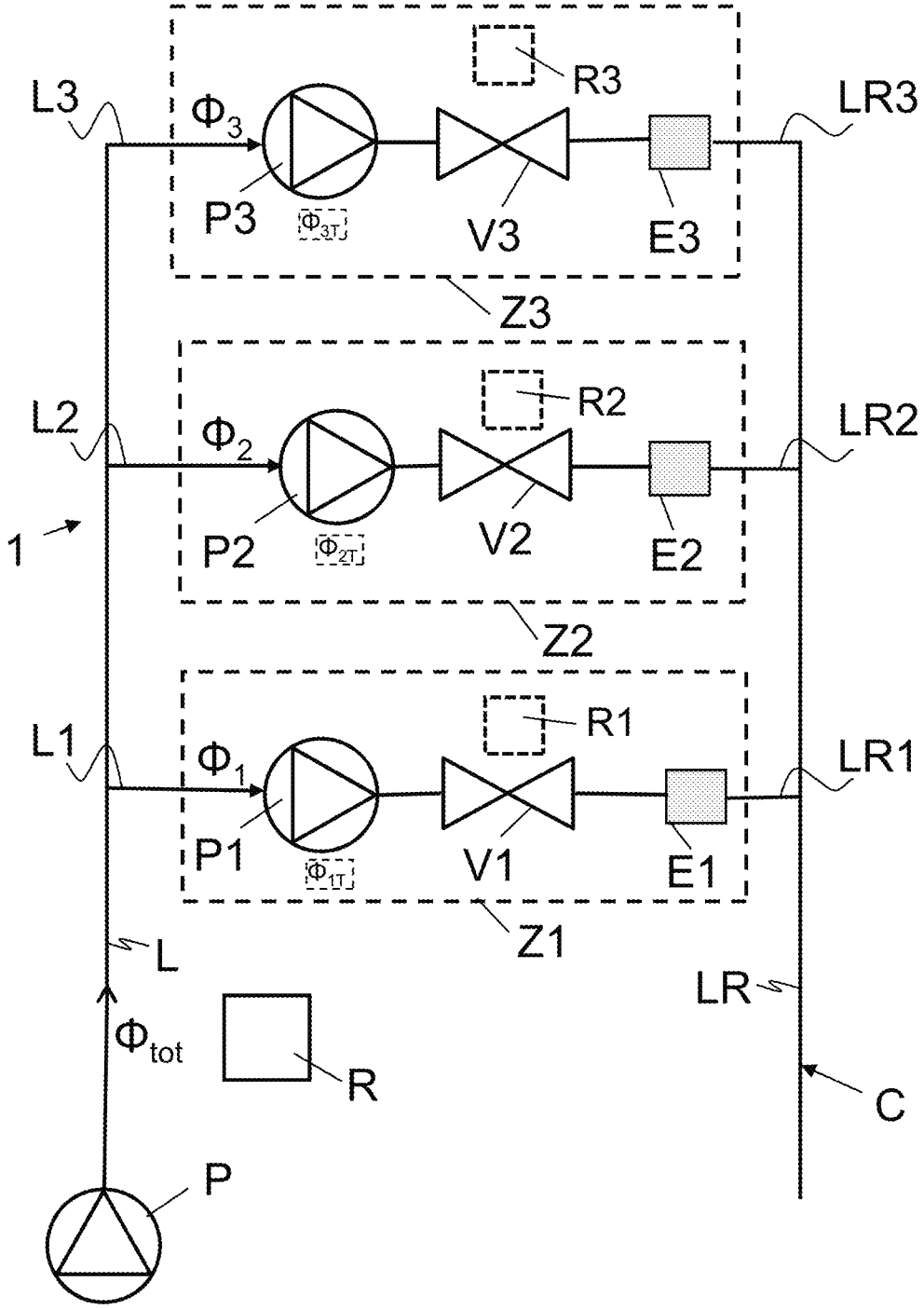
FIG. 2: shows a block diagram illustrating schematically an example of a fluid transportation network, comprising a fluid transportation circuit, a main pump, and three parallel zones in accordance with the disclosure.

In FIGS. 1 to 4, each of the zones Z1, Z2, Z3 is associated with a pump P1, P2, P3 positioned and arranged in the respective zone Z1, Z2, Z3. In other embodiments, the number of pumps is lower than the number of zones Z1, Z2, Z3. In one embodiment there is only one pump arranged in the fluid transportation network 1. As illustrated in FIG. 2, in further embodiments a main pump P is arranged in the (main) supply line L of the fluid transportation network 1. The main pump P is configured to provide the total flow of fluid $\phi_{tot}$ supplied to the plurality of parallel zones Z1, Z2, and Z3. Although not illustrated, it should be noted that a main pump P could also be added in the examples illustrated in FIGS. 3 and 4.

The pumps P1, P2, P3 are configured to control the flow of fluid $\phi_1$, $\phi_2$, $\phi_3$ through the respective zone Z1, Z2, Z3. In one embodiment the pumps P1, P2, P3 are centrifugal pumps, but any other kind of appropriate pump known in the art for the purpose of circulating fluids may be used. In a preferred embodiment, the pumps P1, P2, P3 are variable speed pumps where the speed of the pumps is controlled in each case using a variable speed motor with a variable frequency drive, for example. Parameters of the variable speed pumps are controlled using built-in controller(s) or external controller(s). In a preferred embodiment, the flow provided by the pump varies linearly with the pump speed.

In FIGS. 1-4, reference numerals $\phi_{1T}$, $\phi_{2T}$, $\phi_{3T}$ refer to flow threshold values of the pumps P1, P2, P3 associated with the zones Z1, Z2, Z3. The flow threshold value $\phi_{1T}$, $\phi_{2T}$, $\phi_{3T}$ of a particular pump P1, P2, P3 determines the efficient operating range of the particular pump P1, P2, P3. The person skilled in the art will understand that the flow threshold values of the pumps P1, P2, P3 may be defined by or correspond to the surge limit (or surge line) of the respective pump P1, P2, P3. For flow rates and corresponding flow setpoints above the pump's flow threshold value $\phi_{1T}$, $\phi_{2T}$, $\phi_{3T}$, the respective pump P1, P2, P3 operates within its efficient operating range, where it is capable of regulating efficiently and effectively the flow of fluid to the flow setpoint. For flow rates and corresponding flow setpoints at or below the pump's flow threshold value $\phi_{1T}$, $\phi_{2T}$, $\phi_{3T}$, the respective pump P1, P2, P3 operates outside its efficient operating range, where it is no longer capable of regulating efficiently and effectively the flow of fluid to the flow setpoint. Depending on the embodiment, the flow threshold values $\phi_{1T}$, $\phi_{2T}$, $\phi_{31}$ are each defined as a fixed value of a defined threshold flow rate, a threshold value determined as a ratio (percentage) of the pump's maximum flow rate, a function of a threshold rotational speed of the pump P1, P2, P3, and/or a function of a threshold speed of the pump in relation to a pump pressure ratio, e.g. the ratio of the discharge pressure to the suction pressure at the pump. Depending on the embodiment and/or configuration, the flow threshold values $\phi_{1T}$, $\phi_{2T}$, $\phi_{3T}$ of each pump P1, P2, P3 is in a range from 15% to 50% of the maximum flow of the respective pump P1, P2, P3, preferably in a range 25% to 35% of the pump's maximum flow, e.g. at 30% of the pump's maximum flow. The flow threshold values $\phi_{1T}$, $\phi_{2T}$, $\phi_{3T}$ are determined and/or stored by the processing unit(s) R, R1, R2, R3 associated with the respective pump(s) P1, P2, P3.

Referring further to the embodiments of FIGS. 1 and 2, each zone Z1, Z2, Z3 has one zone valve V1, V2, V3 arranged in the respective zone Z1, Z2, Z3 and configured to control the flow of fluid through the respective zone Z1, Z2, Z3 within the specified operating range of the pumps P1, P2, P3, as outlined above. In another embodiment according to the disclosure, the number of valves V1, V2, V3 is less than the number of zones Z1, Z2, Z3, e.g. some of the zones Z1, Z2, Z3 may comprise only a pump but not a corresponding valve.

Depending on the embodiment and/or configuration, the regulating zone valves V1, V2, V3, depicted schematically in FIGS. 1-4, are implemented as mechanical pressure independent valves, as electronic pressure independent valves (including individual flow sensors and controllers), and/or as several motorized valves which are connected to a common controller and a common flow sensor, for example. In an embodiment, the zone valves V1, V2, V3 are actuated by (electric) motors (not shown) for adjusting the orifice and, thus, the flow of the fluid through the zone valve V1, V2, V3.

Figure 3:
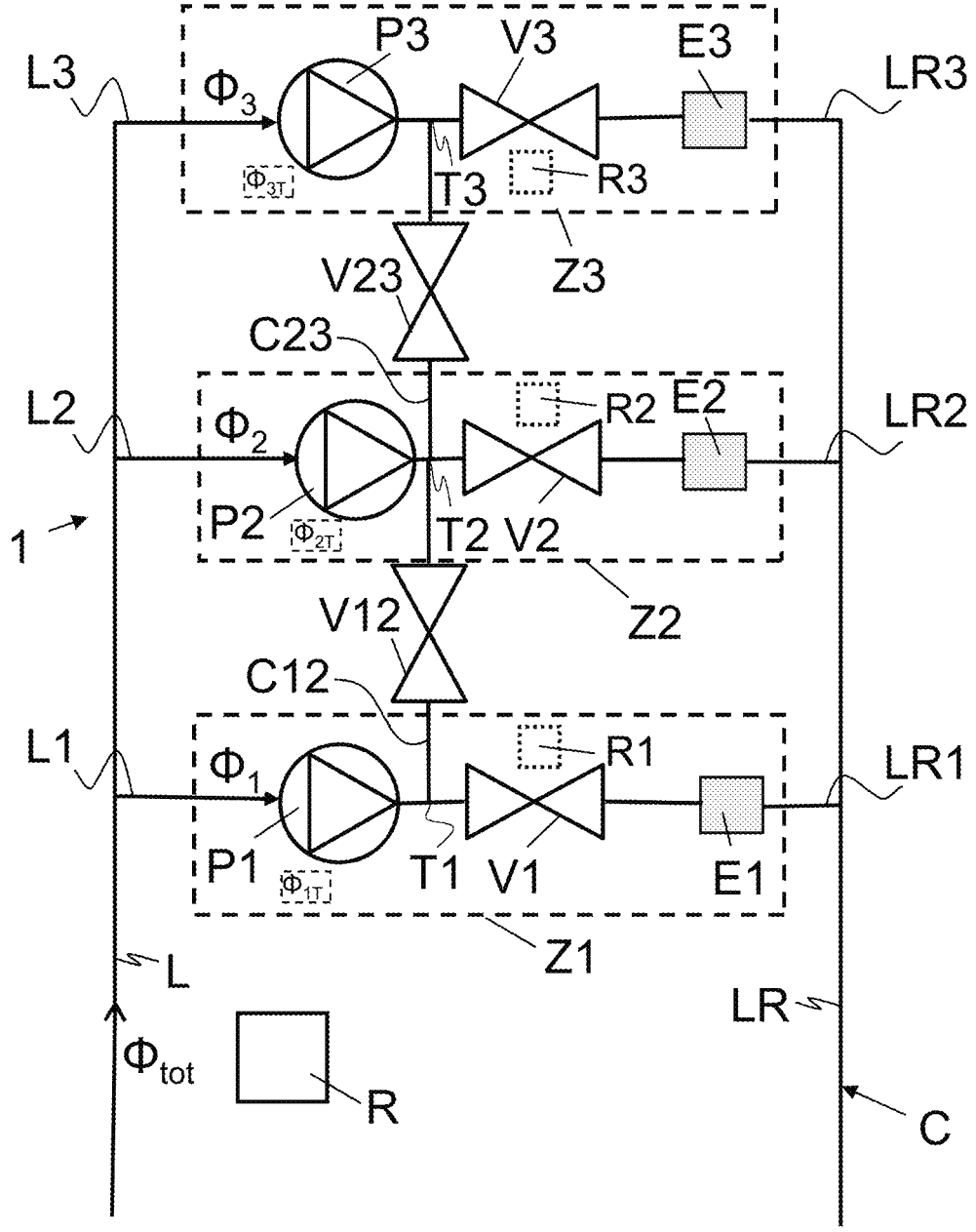
FIGS. 3 and 4: show block diagrams illustrating schematically examples of a fluid transportation network, comprising a fluid transportation circuit, a main pump, and three parallel zones, whereby two parallel zones are connected through a connecting pipe located between the pump and a thermal exchange unit of the respective zone in accordance with the disclosure.
Figure 4:
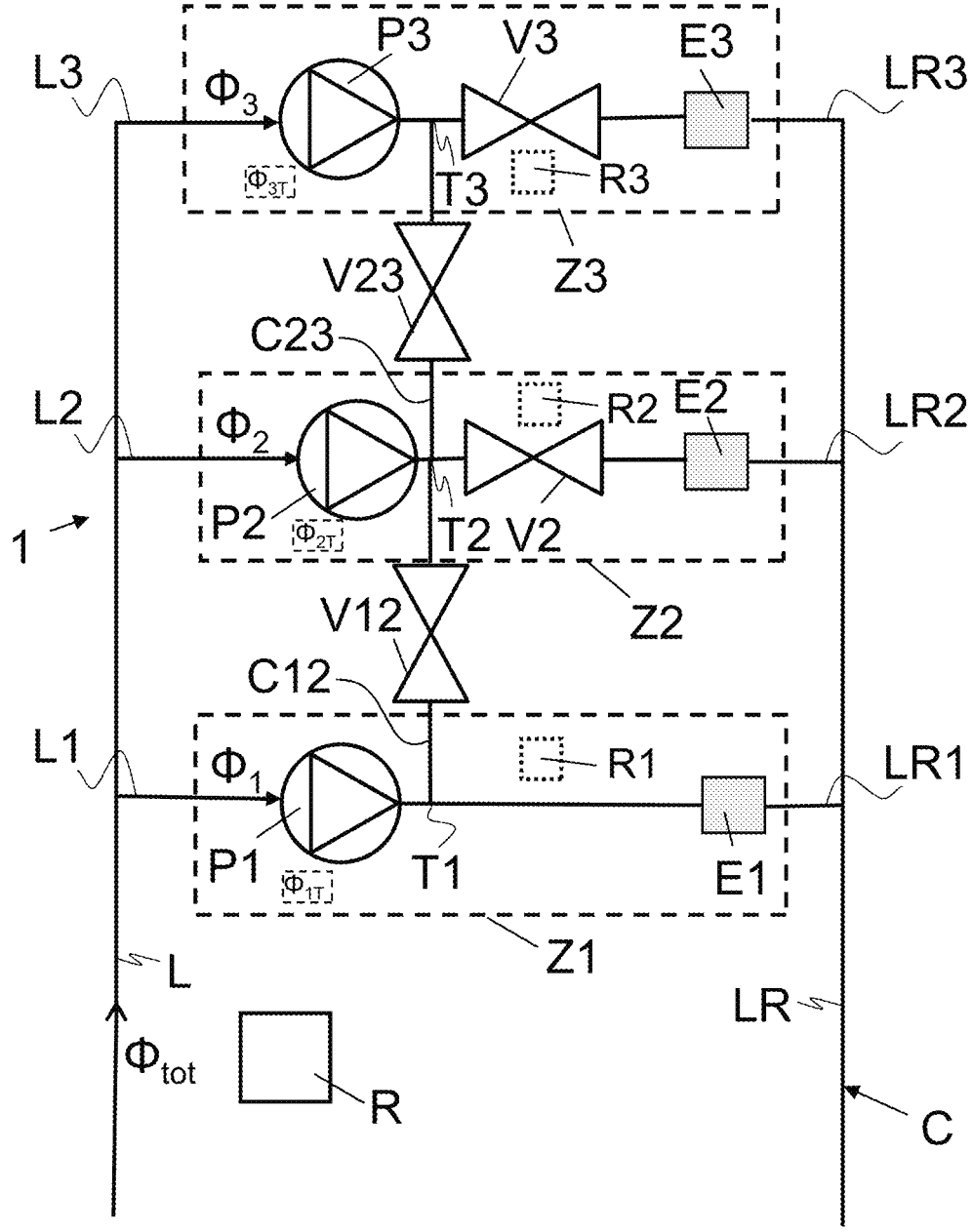

The examples shown in FIGS. 3 and 4 illustrate embodiments or configurations of the fluid transportation network 1 where some of the parallel zones Z1, Z2, Z3 are connected via connecting pipes C12, C23. The connecting pipes C12, C23 are arranged between the pumps P1, P2, P3 and the thermal exchange units E1, E2, E3 of the respective parallel zones Z1, Z2, Z3. In other words, the connecting pipes C12, C23 interconnect junctions T1, T2, T3 in the piping of the parallel zones Z1, Z2, Z3, which junctions T1, T2, T3 are arranged between the pump P1, P2, P3 and the thermal exchange unit E1, E2, E3 of the respective parallel zone Z1, Z2, Z3, downstream of the pump P1, P2, P3 and upstream of the thermal exchange unit E1, E2, E3. In the examples of FIGS. 3 and 4, the parallel zones Z1 and Z2 are connected via connecting pipe C12, interconnecting the junctions T1 and T2; and the parallel zones Z2 and Z2 are connected via connecting pipe C23, interconnecting the junctions T2 and T3. As illustrated in FIGS. 3 and 4, regulating valves V12, V23—referred to as connecting valves V12, V23—are arranged in the respective connecting pipes C12, C23. Depending on the embodiment and/or configuration, the connecting valves V12, V23 are configured as unidirectional valves or as bidirectional valves. For instance, in a unidirectional valve configuration, in the examples of FIGS. 3 and 4, the connecting valve V12 may be arranged to control the flow of fluid from zone Z2 to zone Z1; likewise, the connecting valve V23 may be arranged to control the flow of fluid from zone Z2 to zone Z3. In scenarios where pumps P1 and P3 of the zones Z1 and Z3 are shut off, e.g. because they are operating outside their specified efficient operating range, the connecting valves V12, V23 may actually be configured and controlled to control the flow of fluid in the respective zone Z1, Z3. In the latter case, the pump P2 of zone Z2 would be configured and controlled to supply the flow of fluid to parallel zones Z1, Z2, and Z3. Thus, in cases where one pump P1, P2, P3 provides flow of fluid to more than one parallel zone Z1, Z2, Z3, the flow in these zones Z1, Z2, Z3 is controlled by a regulating valve V1, V2, V3, V12, V23 associated with these zones Z1, Z2, Z3.

As a difference to the exemplary configuration shown in FIG. 3, FIG. 4 illustrates an embodiment or configuration of the fluid transportation network 1 where the parallel zone Z1 is configured without a regulating zone valve arranged between its pump P1 and its thermal exchange unit E1. In this scenario, when pump P1 of Zone Z1 is operated within its specified efficient operating range, pump P1 is controlled to control the flow of fluid through zone 1 to the thermal exchange unit E1. Otherwise, when pump P1 of Zone Z1 is operated outside its specified efficient operating range, the connecting valve V12 is controlled to control the flow of fluid through zone 1 to the thermal exchange unit E1.

Although not illustrated, it should be pointed out that the fluid transportation network 1 comprises one or more flow sensors, e.g. ultrasonic flow sensors, arranged in at least one of the zones Z1, Z2, Z3 and configured to measure the current flow rate in the respective zone Z1 Z2, Z3. The measured current flow rate in a zone Z1, Z2, Z3 is used by the processing units R, R1, R2, R3, the pumps P1, P2, P3, and/or the regulating valves V1, V2, V3, V12, V23 to control the flow of fluid in the respective zone Z1, Z2, Z3 to the flow setpoint for the respective zone Z1, Z2, Z3.

It should be further noted, that in case of a gaseous fluid, e.g. air, the fluid transportation lines L, L1, L2, L3 are implemented as ducts, the zone valves V1, V2, V3 are implemented as dampers, and the pumps P1, P2, P3 are implemented as motorized fans or ventilators.

The fluid transportation network 1 according to the disclosure comprises one or more processing units R, R1, R2, R3. The processing units R, R1, R2, R3 may control the whole fluid transportation network 1, e.g. by a central processing unit R, or part of it, e.g. by individual distributed processing units R1, R2, R3. In FIGS. 1-4, the optional processing units R1, R2, R3 (indicated with dashed lines)

are associated with the corresponding zones Z1, Z2, Z3, and configured to control the valves V1, V2, V3 and/or the pumps P1, P2, P3. In an embodiment, the individual processing units R1, R2, R3, are connected to and/or controlled by the central processing unit R. By controlling valves V1, V2, V3 and/or pumps P1, P2, P3, the processing units R, R1, R2, R3 are controlling the flow of fluid $\phi_1$, $\phi_2$, $\phi_3$ through the zones Z1, Z2, Z3. In some embodiments, the processing units R, R1, R2, and R3 are processing devices that each include an electronic circuit, e.g. a programmable processor, an application specific integrated circuit (ASIC), or another logic unit.

Some or all of the processing units R, R1, R2, R3 further comprise a communication module configured for wireless and/or wired data communication with external processing devices, e.g. another processing unit (or controller), a computerized processing unit operating as a fluid transportation network controller, or another computer or communication device, e.g. a cloud-based computer system, a mobile telephone, or a tablet computer, etc.

The processing units R, R1, R2, R3 are configured to control the pumps P1, P2, P3, zone valves V1, V2, V3, and connecting valves V12, V23 associated with the zones Z1, Z2, Z3 to control the flow of fluid $\phi_1$, $\phi_2$, $\phi_3$ through the respective zones Z1, Z2, Z3. The pumps P1, P2, P3 are only employed to control the flow of fluid $\phi_1$, $\phi_2$, $\phi_3$—alone or in combination with a zone valve V1, V2, V3—when the pumps P1, P2, P3 are operated within their specified efficient operating ranges. For example, the processing units R, R1, R2, R3 are configured to control a particular pump P1, P2, P3 associated with a particular zone Z1, Z2, Z3 to control the flow of fluid $\phi_1$, $\phi_2$, $\phi_3$ through the particular zone Z1, Z2, Z3 to a flow setpoint for the particular zone Z1, Z2, Z3, as long as the respective flow setpoint is above the flow threshold value $\phi_{1T}$, $\phi_{2T}$, $\phi_{3T}$ of the particular pump P1, P2, P3 associated with the particular zone Z1, Z2, Z3. In an embodiment, the zone valve V1, V2, V3 of the particular zone Z1, Z2, Z3 is set and kept to a fully open position while the particular pump P1, P2, P3 associated with the particular zone Z1, Z2, Z3 controls the flow of fluid through the particular zone Z1, Z2, Z3 within the particular pump's specified efficient operating range. Thus, in the latter case, the flow of fluid $\phi_1$, $\phi_2$, $\phi_3$ through the particular zone Z1, Z2, Z3 is controlled entirely by the respective pump P1, P2, P2 operating in its specified efficient operating range.

The processing units R, R1, R2, R3 are further configured to pass regulating control from the pumps P1, P2, P3 associated with the zones Z1, Z2, Z3 to the zone valves V1, V2, V3 associated with the zones Z1, Z2, Z3 to control the flow of fluid $\phi_1$, $\phi_2$, $\phi_3$ through the respective zones Z1, Z2, Z3, outside the specified efficient operating range of the pumps P1, P2, P3. For example, the processing units R, R1, R2, R3 are configured to pass regulating control from a particular pump P1, P2, P3 associated with a particular zone Z1, Z2, Z3 to the particular zone valve V1, V2, V3 associated with the particular zone Z1, Z2, Z3, as long as the flow setpoint for the particular zone Z1, Z2, Z3 is at or below the flow threshold value $\phi_{1T}$, $\phi_{2T}$, $\phi_{3T}$ of the particular pump P1, P2, P3 associated with the particular zone Z1, Z2, Z3. Depending on the type of zone valves V1, V2, V3, the processing units R, R1, R2, R3 are configured to control the zone valves V1, V2, V3 associated with the zones Z1, Z2, Z3 to control the flow of fluid $\phi_1$, $\phi_2$, $\phi_3$ through the respective zones Z1, Z2, Z3, outside the specified efficient operating range of the pumps P1, P2, P3, e.g. when the flow setpoints for the respective zones Z1, Z2, Z3 are at or below the flow threshold value $\phi_{1T}$, $\phi_{2T}$, $\phi_{3T}$ of the pumps P1, P2, P3 associated with the respective zone Z1, Z2, Z3. In other words, in the latter case, the processing units R, R1, R2, R3 are configured to control a particular zone valve V1, V2, V3 associated with a particular zone Z1, Z2, Z3 to control the flow of fluid $\phi_1$, $\phi_2$, $\phi_3$ through the particular zone Z1, Z2, Z3, when the flow setpoint for the particular zone Z1, Z2, Z3 is at or below the flow threshold value $\phi_{1T}$, $\phi_{2T}$, $\phi_{3T}$ of the particular pump P1, P2, P3 associated with the particular zone Z1, Z2, Z3. In an embodiment, the particular pump P1, P2, P3 associated with the particular zone Z1, Z2, Z3 is set and kept to a fixed pass through mode while the zone valve V1, V2, V3 associated with the particular zone Z1, Z2, Z3 controls the flow of fluid through the particular zone Z1, Z2, Z3, outside the specified efficient operating range of the particular pump P1, P2, P3. Thus, in the latter case, the flow of fluid $\phi_1$, $\phi_2$, $\phi_3$ through the particular zone Z1, Z2, Z3 is controlled entirely by the respective zone valve V1, V2, V3. In cases and scenarios when only the zone valves V1, V2, V3 are used to control the flow of fluid in the fluid transportation network 1, the processing units R, R1, R2, R3 are further configured to set to a fully open position the zone valve V1, V2, V3 which already has the greatest valve position, i.e. the zone valve V1, V2, V3 with the greatest orifice closest to a fully open position, by adjusting the speed of the main pump P, arranged in the supply line L, or the speed of one of the pumps P1, P2, P3 associated with the zones Z1, Z2, Z3.

In further embodiments, the fluid transportation network 1 further comprises one or more non-return valves, arranged in each case downstream of a pump P, P1, P2, P3. In the configurations with a main pump P, the non-return valve is arranged in the main supply line L downstream of the main pump P, directly "behind" the main pump P (without any intervening flow controlling parts or components). In an embodiment, the main pump P is controlled to overpressure the flow, e.g. by 20 kpa, consequently, the individual pumps P1, P2, P3 in the zones Z1, Z2, Z3 can be switched off in cases where only a low flow is required in the respective zone Z1, Z2, Z3, e.g. 20% of maximum flow, and the main pump P is sufficient to provide the required flow or pressure, respectively. For the pumps P1, P2, P3 arranged in and associated with a zone Z1, Z2, Z3, the non-return valves are arranged in each case downstream of the pump P1, P2, P3, upstream of the junction where the respective zone Z1, Z2, Z3 reconnects to the main return line LR.

The invention claimed is:

1. A fluid transportation network comprising:

a plurality of parallel zones;

a common supply line for feeding a total flow of fluid to the plurality of parallel zones, each parallel zone of the plurality of parallel zones being connected to the common supply line and associated with a pump, the pump being configured to control a flow of fluid through the respective parallel zone of the plurality of parallel zones;

at least one zone valve arranged in one of the parallel zones of the plurality of parallel zones and configured to control the flow of fluid through the one of the plurality of parallel zones; and a processor configured to control at least one of the pumps, associated with the parallel zones of the plurality of parallel zones, and/or the at least one zone valve, to control the flow of fluid through the parallel zones of the plurality of parallel zones, wherein the pumps are used to control the flow of fluid through a particular parallel zone of the plurality of parallel zones or the plurality of parallel zones only when a respective pump is operating within a specified efficient operating range of the respective pump, wherein only the zone valve is used to control the flow in the particular parallel zone of the plurality of parallel zones when the respective pump is operating outside the specified efficient operating range of the respective pump, and wherein the respective pump regulates a flow of fluid above a respective flow threshold value of the respective pump.

2. The fluid transportation network of claim 1, wherein the processor is configured to control the respective pump to control the flow of fluid through a particular parallel zone of the plurality of parallel zones only when the flow setpoint for the particular parallel zone of the plurality of parallel zones is above the respective flow threshold value of the respective pump.

3. The fluid transportation network of claim 1, wherein the flow of a particular parallel zone of the plurality of parallel zones is controlled by the one pump associated with that particular parallel zone of the plurality of parallel zones.

4. The fluid transportation network of claim 1, wherein at least one pump is configured to deliver flow in more than one parallel zone of the plurality of parallel zones, and the flow of the more than one parallel zone of the plurality of parallel zones is controlled by an individual valve for each of the more than one parallel zone of the plurality of parallel zones.

5. The fluid transportation network of claim 1, wherein only the zone valve of a particular parallel zone of the plurality of parallel zones is used to control the flow in the particular parallel zone of the plurality of parallel zones when the flow setpoint for the particular parallel zone of the plurality of parallel zones is at or below the respective flow threshold value.

6. The fluid transportation network of claim 1, wherein at least one of the parallel zones of the plurality of parallel zones comprises a flow sensor.

7. The fluid transportation network of claim 1, wherein the flow threshold value of at least one pump is in a range from 15% to 50% of a maximum flow of the respective pump.

8. The fluid transportation network of claim 1, wherein at least two parallel zones of the plurality of parallel zones are connected through a connecting pipe, located between the pump and a thermal exchanger of the respective parallel zones of the plurality of parallel zones, and wherein the connecting pipe comprises a connecting valve.

9. The fluid transportation network of claim 8, wherein the connecting valve is associated with one of the parallel zones of the plurality of parallel zones and configured to control the flow in the one of the parallel zones of the plurality of parallel zones.

10. The fluid transportation network of claim 1, wherein the respective flow threshold value of the pump is a function of a threshold rotational speed of the pump or of a threshold rotational speed of the pump in relation to a pump pressure ratio.

11. The fluid transportation network of claim 1, further comprising a main pump configured to provide the total flow of fluid.

12. The fluid transportation network of claim 1, wherein the processor comprises a plurality of separate processors, and/or wherein each of the parallel zones of the plurality of parallel zones comprises a zone processor.

13. The fluid transportation network of claim 1, wherein the fluid is a liquid or gaseous fluid.

14. The fluid transportation network of claim 1, wherein each parallel zone of the plurality of parallel zones comprises one or more thermal exchangers.

15. The fluid transportation network of claim 1, wherein the flow of a particular parallel zone of the plurality of parallel zones is controlled by the pump arranged in the particular parallel zone of the plurality of parallel zones.

16. A method of controlling a fluid transportation network including a plurality of parallel zones, a common supply line for feeding a total flow of fluid to the plurality of parallel zones, each parallel zone of the plurality of parallel zones being connected to the common supply line and associated with a pump, the pump being configured to control a flow of fluid through the respective parallel zone of the plurality of parallel zones, and at least one zone valve arranged in one of the parallel zones of the plurality of parallel zones and configured to control the flow of fluid through the one of the plurality of parallel zones, the method comprising:

supplying a total flow of fluid to the common supply line;

dividing the total flow of fluid into a flow of fluids for each parallel zone of the plurality of parallel zones;

regulating the flow of fluids in each parallel zone of the plurality of parallel zones using a respective pump and/or a zone valve, wherein the regulating comprises:

controlling, by the respective pump, alone or in combination with the zone valve, the flow in a particular parallel zone of the plurality of parallel zones only when the respective pump is operating within a specified efficient operating range of the respective pump, the respective pump regulating a flow of fluid above a respective flow threshold value of the respective pump; and controlling, by only the zone valve, the flow in the particular parallel zone of the plurality of parallel zones when the respective pump is operating outside the specified efficient operating range of the respective pump.

17. The method of claim 16, wherein the respective pump is used to control the flow of fluid through the particular parallel zone of the plurality of parallel zones only when the flow setpoint for the particular parallel zone of the plurality of parallel zones is above the respective flow threshold value of the respective pump.

18. The method of claim 16, wherein, when only the zone valves are used to control the flow of fluid in the fluid transportation network, at least one of the zone valves is set to a completely open position by adjusting a speed of a main pump, arranged in the supply line, or the speed of one of the pumps associated with the parallel zones of the plurality of parallel zones.

* * * * *